US010578034B2

(12) United States Patent
MacDonald

(10) Patent No.: US 10,578,034 B2
(45) **Date of Patent: *Mar. 3, 2020**

(54) SYSTEM AND METHOD FOR IMPROVING PERFORMANCE OF COMBUSTION ENGINES EMPLOYING PRIMARY AND SECONDARY FUELS

(71) Applicant: BMS-TEK, LLC, Melbourne, FL (US)

(72) Inventor: John Joseph MacDonald, Port Orange, FL (US)

(73) Assignee: BMS-TEK, LLC, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/436,986

(22) PCT Filed: Jan. 9, 2014

(86) PCT No.: PCT/US2014/010936

§ 371 (c)(1),
(2) Date: Apr. 20, 2015

(87) PCT Pub. No.: WO2014/110295

PCT Pub. Date: Jul. 17, 2014

(65) Prior Publication Data

US 2015/0275780 A1 Oct. 1, 2015

Related U.S. Application Data

(60) Provisional application No. 61/750,650, filed on Jan. 9, 2013.

(51) Int. Cl.
*F02D 19/06* (2006.01)
*F02M 25/12* (2006.01)
(Continued)

(52) U.S. Cl.
CPC ..... *F02D 19/0644* (2013.01); *F02D 19/0602* (2013.01); *F02D 19/0642* (2013.01);
(Continued)

(58) Field of Classification Search
CPC ..... F02D 19/00; F02D 19/02; F02D 19/021; F02D 19/022; F02D 19/023;
(Continued)

(56) References Cited

U.S. PATENT DOCUMENTS 3,621,658 A * 11/1971 Grebe ..... H02K 44/08 60/773
4,166,437 A * 9/1979 Bianchi ..... F02D 41/1487 123/406.44
(Continued)

FOREIGN PATENT DOCUMENTS

DE 2010045593 3/2012
WO WO2010009248 1/2010
(Continued)

*Primary Examiner* — Kevin R Steckbauer

(57) ABSTRACT

An engine system and method for operating an internal combustion engine in dynamically varying conditions. An exemplary system comprises an internal combustion engine configured to receive both a primary fuel and a secondary fuel into one or more chambers in which a combustion process occurs, a fuel injection system, an air intake manifold and a fuel manifold; an electronic system which controls timing and metering of the primary fuel and/or the secondary fuel in the combustion process; and a plurality of sensors positioned to measure one or more variables associated with combustion of the primary fuel in the presence of the secondary fuel. The electronic system is configured to apply a control signal to adjust an engine setting to reduce NOx emissions based in part on the magnitude of the variable.

20 Claims, 12 Drawing Sheets

(51) Int. Cl.

| | |
|---|---|
| ***F02D 41/14*** | (2006.01) |
| ***F02D 41/00*** | (2006.01) |
| ***F02D 41/04*** | (2006.01) |
| ***F02D 41/24*** | (2006.01) |
| *F02D 21/08* | (2006.01) |
| *F02D 41/26* | (2006.01) |

(52) U.S. Cl.
CPC ..... *F02D 41/0025* (2013.01); *F02D 41/0027* (2013.01); *F02D 41/04* (2013.01); *F02D 41/1446* (2013.01); *F02D 41/1461* (2013.01); *F02D 41/24* (2013.01); *F02M 25/12* (2013.01); *F02D 41/266* (2013.01); *F02D 2021/083* (2013.01)

(58) Field of Classification Search
CPC .... F02D 19/024; F02D 19/026; F02D 19/027; F02D 19/061; F02D 19/0642; F02D 19/0644; F02D 19/0647; F02D 19/08; F02D 19/081; F02D 19/10; F02D 35/0015; F02D 35/0046
USPC ..... 123/27 GE, 472, 478
See application file for complete search history.

(56) References Cited

U.S. PATENT DOCUMENTS 4,178,883 A * 12/1979 Herth ..... F02D 41/1474 123/687
4,463,734 A * 8/1984 Akeroyd ..... F02D 19/066 123/27 GE
4,641,625 A * 2/1987 Smith ..... F02D 19/0628 123/27 GE
4,955,326 A * 9/1990 Helmich ..... F02B 7/06 123/27 GE
5,219,228 A * 6/1993 Ker ..... F02D 41/1446 324/713
5,224,457 A * 7/1993 Arsenault ..... F02B 43/00 123/27 GE
5,394,330 A 2/1995 Horner
5,394,849 A * 3/1995 Tomisawa ..... F02D 35/023 123/435
5,450,829 A * 9/1995 Beck ..... F02D 19/0631 123/435
5,515,280 A * 5/1996 Suzuki ..... F02D 41/0025 701/29.2
6,155,212 A 12/2000 McAlister
6,240,910 B1 * 6/2001 Maekawa ..... F02D 41/0027 123/198 D
6,289,871 B1 * 9/2001 Brown ..... F02D 19/0628 123/299
7,222,015 B2 * 5/2007 Davis ..... F02D 19/027 701/103
7,270,089 B2 * 9/2007 Wong ..... F02D 19/105 123/27 GE
7,290,504 B2 * 11/2007 Lange ..... C01B 3/323 123/1 A
7,344,789 B2 * 3/2008 Barber ..... C01B 3/38 423/648.1
7,789,047 B2 * 9/2010 Kuroki ..... C01B 3/02 123/1 A
7,806,111 B2 * 10/2010 Figl ..... F01L 1/0532 123/670
7,913,675 B2 * 3/2011 Bailey ..... F02B 19/12 123/568.21
7,958,866 B2 * 6/2011 Thomas ..... F02D 41/0027 123/379
8,214,128 B2 * 7/2012 Watkins ..... F02D 19/027 123/27 GE
8,706,383 B2 * 4/2014 Sauve ..... F02D 41/0025 123/434
8,706,386 B2 * 4/2014 Kurtz ..... F02D 41/0025 701/109
8,903,630 B2 * 12/2014 Pursifull ..... F02D 19/0615 123/431
9,038,606 B1 * 5/2015 Joshi ..... F02D 41/0025 123/526
9,752,515 B1 * 9/2017 Stroup ..... F02D 41/26
9,856,837 B2 * 1/2018 Dunn ..... F02M 43/00
10,161,318 B2 * 12/2018 Stroup ..... F02D 41/26
10,253,685 B2 * 4/2019 Alexander ..... F02M 25/12
2005/0029872 A1 10/2005 Lange
2005/0229872 A1 * 10/2005 Lange ..... C01B 3/323 123/3
2007/0000456 A1 * 1/2007 Wong ..... F02D 19/105 123/27 GE
2009/0078236 A1 * 3/2009 Gallagher ..... F02D 35/02 123/480
2010/0180838 A1 * 7/2010 Lewis, III ..... C01B 3/32 123/3
2010/0206721 A1 * 8/2010 Snidvongs ..... C25B 1/04 204/229.8
2010/0217500 A1 * 8/2010 Watkins ..... F02D 19/027 701/103
2011/0067652 A1 * 3/2011 Bishop ..... F01P 7/04 123/3
2011/0166769 A1 * 7/2011 Buechler ..... F02D 23/00 701/103
2013/0066536 A1 * 3/2013 Watkins ..... F02B 1/14 701/104
2013/0220274 A1 * 8/2013 Deshpande ..... F02D 19/105 123/350
2013/0311066 A1 * 11/2013 Guimaraes ..... F02D 41/3094 701/104
2013/0338901 A1 * 12/2013 Kumar ..... F02D 19/0639 701/102
2013/0340717 A1 * 12/2013 Avery ..... F02D 41/30 123/478
2014/0182560 A1 * 7/2014 Veit ..... F02D 41/1406 123/478
2014/0209066 A1 * 7/2014 Fiveland ..... F02D 19/0626 123/457
2014/0238340 A1 * 8/2014 Dunn ..... F02M 43/00 123/299
2015/0176509 A1 * 6/2015 Lavertu ..... F02D 19/0647 123/27 GE
2015/0226113 A1 * 8/2015 Alexander ..... F02D 19/08 123/3
2018/0283291 A1 * 10/2018 Stroup ..... F02D 41/26

FOREIGN PATENT DOCUMENTS

WO WO2010078828 1/2010
WO WO2011082493 7/2011
WO WO 2011153069 A1 * 12/2011 ..... F02D 19/105

* cited by examiner

SYSTEM AND METHOD FOR IMPROVING PERFORMANCE OF COMBUSTION ENGINES EMPLOYING PRIMARY AND SECONDARY FUELS

RELATED APPLICATION

This national stage application claims priority to PCT Application PCT/US2014/10936 filed Jan. 9, 2014 which claims the benefit of provisional patent application U.S. 61/750,650 filed 9 Jan. 2013.

FIELD OF THE INVENTION

The present invention relates to internal combustion engines and, more specifically, to systems and methods which reduce exhaust emissions without degrading other engine performance parameters such as fuel efficiency.

BACKGROUND

Environmental compliance in the transportation industry continues to be problematic for society. Control of emissions levels is particularly costly for the commercial ground transportation industry because Compression Ignition (CI) engines have a set of technical challenges different from Spark Ignition (SI) engines. Present and future emissions compliance demand systems advancements in diesel engine technology. Solutions increase vehicle costs and elevate maintenance costs. Another undesirable outcome which stems from compliance with NOx emissions standards relates to the further generation of greenhouse gases, as reductions in fuel efficiency have been accepted as a necessary cost of compliance with NOx emissions standards.

Ideally, optimum fuel efficiency in a diesel or gasoline powered internal combustion engine requires adjustment to a relatively high air-to-fuel ratio such that the ratio is positioned away from a relatively rich fuel content to a slightly fuel rich ratio that is relatively close to the stoichiometric ratio. FIG. 1 is exemplary. With this higher combustion efficiency there is a relatively high combustion temperature which generates a greater mechanical force than achieved at lower combustion temperatures. This results in a relatively higher power output. It is also widely acknowledged in the literature that the higher combustion temperature results in higher NOx emissions levels. See FIGS. 1 and 2. Clearly, implementing environmentally acceptable solutions for controlling NOx emissions runs counter to the air-to-fuel configurations which result in more optimal fuel efficiencies and lower CO, HC and Soot emissions.

Despite this drawback, it is widely accepted that control of NOx emissions in diesel engines must be addressed with some form of an Exhaust Gas Recirculation (EGR) system which re-uses spent combustion gases. Typically, EGR systems recirculate gases from the exhaust manifold through the intake manifold. The extent of recirculation may range from 10 percent to over 50 percent. This affects reduction in the oxygen content at the intake manifold, effectively depressing the air-to-fuel ratio. With relatively rich fuel content in the combustion chamber, the reaction is shifted further away from the stoichiometric ratio. This, in turn, reduces the combustion temperature to a level which reduces NOx generation to a more acceptable level, perhaps up to about a fifty percent reduction. However, as the level of exhaust recirculation increases, there is increased heat rejection which requires a larger cooling system. Another drawback is that with exhaust gas recirculation diluting the volume percent of oxygen entering the engine from the intake manifold, the engine power density decreases. This gives rise to a need for a larger displacement engine to achieve the same power output. Also, when the volume percent of oxygen decreases, more soot is generated and more unburned hydrocarbons are also carried out the exhaust. With regulatory limits on both particulate matter and unburned hydrocarbons it has become necessary to incorporate additional equipment in the engine exhaust system, e.g., diesel particulate filters which may remove only about eighty five percent of the particulate matter. Generally, EGR systems require additional components to overcome or offset the aforementioned drawbacks. They result in excessive engine wear and higher maintenance requirements due, for example, to entry of carbon into the motor oil.

It is also recognized that an EGR system cannot, alone, provide sufficient NOx emission reductions to comply with many current and future emissions requirements. Due to the aforementioned drawbacks of EGR systems in diesel engines, original equipment manufacturers have incorporated systems with other means to reduce NOx emissions and to even reduce the percentage of exhaust gas recirculation. Selective Catalytic Reduction (SCR) systems are exemplary. Such systems inject an aqueous solution of urea into the exhaust flow in the presence of a catalyst to convert the NOx into molecular nitrogen and water. Treatment of exhaust gases by catalytic reduction after initial NOx removal with an EGR system enables engine operations to meet current regulatory requirements; and while it is essential to incorporate exhaust gas recirculation in diesel engines to meet emission level standards, the necessary level of recirculation can be reduced with an SCR system. Ideally, alternate means for reducing the NOx emissions should completely supplant the need for EGR systems.

The simplified schematic diagram of FIG. 3 illustrates a contemporary CI engine system 1 having a diesel fueled multicylinder engine 3 having an engine control system, an EGR emissions control system and a secondary exhaust emissions control system. The emissions control systems limit exhaust levels of NOx, particulate matter and hydrocarbons. Illustrated engine components include cylinders 11 in each of which a piston 13 is positioned for movement to compress an air-fuel mixture within a combustion chamber region 15. The engine includes an air intake manifold 19 which receives pressurized air from an intake 21 via a turbocharger 23. A positive displacement pump 31 sends pressurized fuel through the fuel rail 33 to an injector 35 for each cylinder. Exhaust from the combustion chambers exits the engine through the exhaust manifold 39, the turbocharger 23 and the exhaust pipe 43. The EGR emissions control system comprises an EGR manifold 45 connected between the exhaust manifold 39 and the air intake manifold 19 to mix a percentage of the exhaust with air received into the intake 21. An EGR valve 49 positioned in-line with the EGR manifold 45 regulates the amount of exhaust being returned to the combustion chambers via the intake manifold 19.

The secondary exhaust emissions control system includes electronic controller 51, a Diesel Particulate Filter 53 and a Selective Catalytic Reducer 55, each in line with the exhaust pipe 43. Upstream of the Filter 53 there are positioned in the exhaust pipe 43 an exhaust temperature sensor 57 and a NOx sensor 59 which each provide a signal 57*s* or 59*s* only to the controller 51. An intermediate temperature sensor 61 is positioned in the exhaust pipe between the filter 53 and the Selective Catalytic Reducer 55. An output NOx sensor 63 positioned in the exhaust pipe 5 measures the NOx level in exhaust leaving the pipe 43. The intermediate temperature sensor 61 and the NOx sensor 63 each provide a signal 61*s* or 63*s* only to the controller 51.

The engine control system comprises an Electronic Control Unit (ECU) 71 which is connected to receive signals from each of an intake manifold pressure sensor 75, an exhaust pressure sensor 77, a fuel rail pressure sensor 79, a barometric pressure sensor 81 and a crank shaft position sensor 83. The ECU also sends a control signal 87 to the EGR valve 49 to regulate the amount of exhaust flow recirculated into the manifold 19 and a control signal 89 to regulate the timing and duration of the opening of the fuel injector 35.

BRIEF DESCRIPTION OF THE FIGURES

The following drawings are provided to facilitate understanding of the inventive concepts described in the written description which follows, where.

Like reference numbers are used throughout the figures to denote like components. Numerous components are illustrated schematically, it being understood that various details, connections and components of an apparent nature are not shown in order to emphasize features of the invention. Various features shown in the figures are not shown to scale in order to emphasize features of the invention.

DETAILED DESCRIPTION OF THE INVENTION

Before describing in detail the particular methods and systems and components relating to embodiments of the invention, it is noted that the present invention resides primarily in a novel and non-obvious combination of components and process steps. So as not to obscure the disclosure with details that will be readily apparent to those skilled in the art, certain conventional components and steps have been omitted or presented with lesser detail, while the drawings and the specification describe in greater detail other elements and steps pertinent to understanding the invention. Further, the following embodiments do not define limits as to structure or method according to the invention, but provide examples which include features that are permissive rather than mandatory and illustrative rather than exhaustive.

Figure 1:
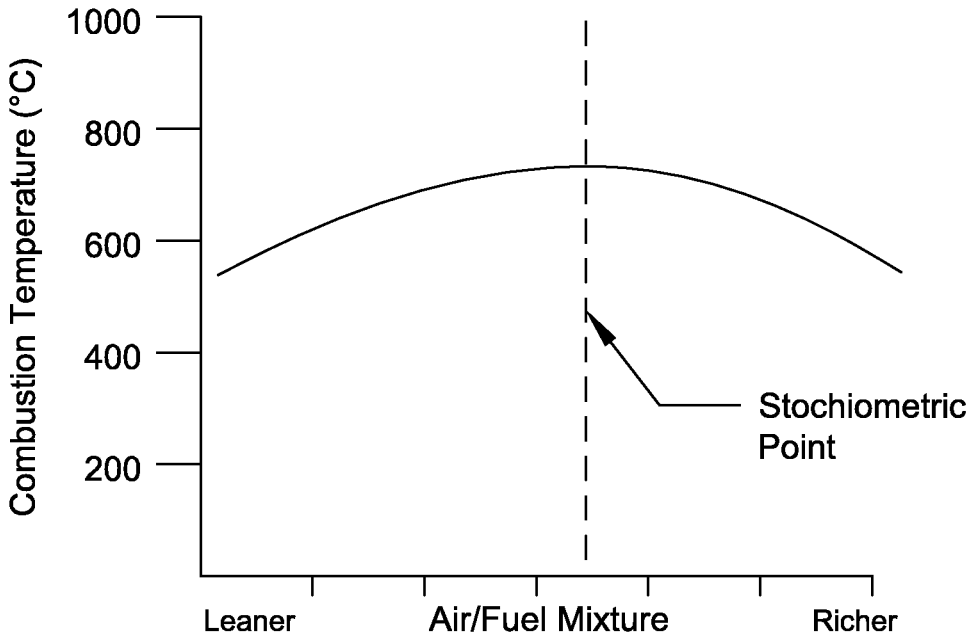
Figure 1 Prior Art
FIG. 1 illustrates a general relationship between the air-to-fuel ratio and combustion temperature for an internal combustion engine.
Figure 2:
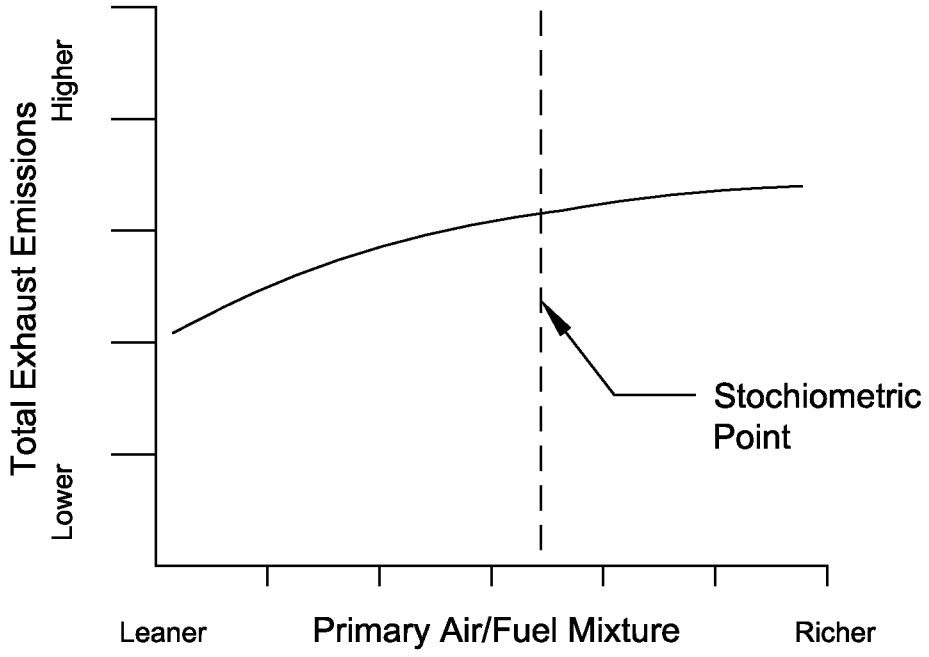
Figure 2 Prior Art
FIG. 2 illustrates a relationship between the air-to-fuel ratio and NOx emissions for an internal combustion engine which, in conjunction with FIG. 1, indicates a relationship between combustion temperature and NOx emissions.
Figure 3:
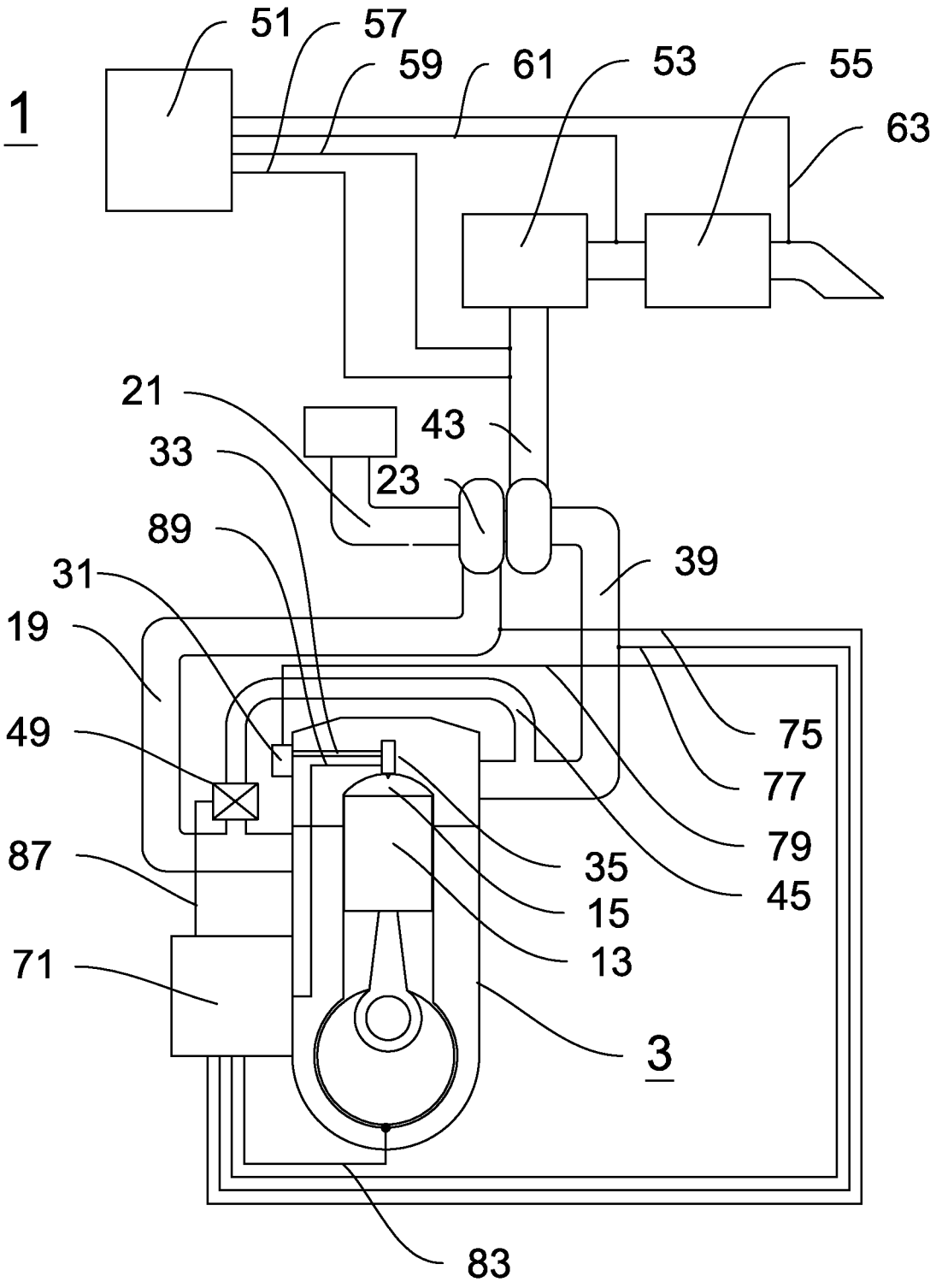
Figure 3 Prior Art
FIG. 3 is a simplified schematic diagram of a prior art CI engine system.

With reference to FIG. 4, there is shown a CI engine system 100 according to an embodiment of the invention. Although not illustrated in all of the figures, the system 100 may include the secondary exhaust emissions control system (e.g., an electronic controller 51, a Diesel Particulate Filter 53 and a Selective Catalytic Reducer 55). The system 100 also includes many of the other features of the engine system 1 as shown in FIG. 3. Like features in these and other illustrated embodiments are identified with like reference numbers. In addition, the system 100 includes a NOx control system which comprises a control module 104, a hydrogen generation system 106, an exhaust gas temperature sensor 108, and a NOx sensor 112.

Hydrogen generation systems suitable for practicing the invention are designed to produce hydrogen-containing gaseous products suitable for injection into an engine combustion chamber because they contain reactive hydrogen. The term hydrogen containing gaseous products as used herein and in the claims means products which contain reactive hydrogen, i.e., containing atomic hydrogen (H) or molecular hydrogen ($H_2$) or hydrogen in the form $H^+$, $OH^-$, $O^-+H^+$, or $H_2O_2$ suitable for use in an internal combustion engine to facilitate enhanced performance when also burning another fuel. The hydrogen containing gaseous products may contain other components such as $H_2O$. When the gaseous product is generated by electrolysis the product includes oxygen where the ratio of hydrogen to oxygen is 2:1 and the material is referred to as oxyhydrogen or HHO. Although disclosed embodiments of the invention include hydrogen generation systems which produce a reactive hydrogen species, the hydrogen-containing gaseous products include pre-prepared secondary fuel containing reactive hydrogen. Also, a hydrogen generation system may produce reactive hydrogen in situ in the presence of heat and a catalytic material such as copper. For example, a light hydrocarbon such as methane may be passed through a variable number of heated copper tubes to provide a supply of reactive hydrogen. The process may involve generation of a plasma or thermal cracking or a uv photoelectric process.

Embodiments of the invention are in recognition that, because an ECU modifies certain engine variables in response to changes in sensor data (e.g., pulse widths of fuel injection timing signals), the same input terminals of an ECU utilizing this sensor data can be used to further change engine parameters, e.g., in a cumulative manner, based on information provided to the terminal in addition to or in place of the data received directly from the sensor. Thus received sensor signal data can be modified based on additional information in order to further alter those engine variables of interest in response to changing conditions such as a change in the air-to-fuel ratio resulting from a change in the rate of flow of a secondary fuel into the intake manifold of the engine.

With reference to FIG. 4, when a signal generated by such a sensor is received as a voltage magnitude, the signal is routed into the control module 104 prior to input to the ECU 71 for conversion to a digital signal, and a digital adjustment is made to provide a different signal magnitude. The adjusted signal magnitude then undergoes a digital-to-analog conversion to provide a modified analog signal representative of the adjusted magnitude for input to the ECU. Generally, the sensor of the modified control loop may be any sensor useful for adjusting an engine parameter. With the magnitude output by a sensor being representative of fuel rail pressure, the ECU 71 might normally adjust the volumetric flow of the primary fuel into the combustion engine chambers based solely on a change in fuel rail pressure. Instead, an adjusted version of the magnitude sensor output is provided as the pressure sensor input to the ECU. This causes a shift in the programmed volumetric flow rate of the primary fuel relative to the flow rate which would otherwise result based on a direct and unaltered measurement of the fuel rail pressure.

To effect this modification of any sensor signal input to the ECU 71, the control module 104 may be microprocessor based and programmed in accord with an algorithm or may access values from a look-up table. More simply, the control module may apply one or more predefined offset values to adjust the sensor magnitude as a digital signal or as an analog signal. In the illustrated embodiments this control module functionality is implemented with a microprocessor. It is to be understood that in embodiments which integrate functions of the control module 104 with the OEM ECU, separate analog-to-digital and digital-to-analog conversions may not be necessary.

In embodiments of the invention, the control module may include an algorithm, a look-up table or, more simply, one or more predefined offset values, which are applied to adjust the volumetric flow of the primary fuel to improve engine performance while a secondary fuel is sent into the combustion chamber regions. The magnitude of voltage adjustment made by the control module 104 may simply be a fixed value based on analysis of engine performance under differing rates of primary fuel delivery (e.g., diesel fuel delivery) and manifold pressure while both the primary and the secondary fuel are applied. Other embodiments include variable voltage shifts for the sensor value to more optimally adjust the rate of fuel delivery, e.g., based on varying engine dynamics or changes in ambient conditions. The secondary fuel may be held at a fixed flow rate while the analysis is performed by varying primary fuel input rates or an algorithm may provide adjustment based in part on varied flow rate of the secondary fuel.

Figure 8:
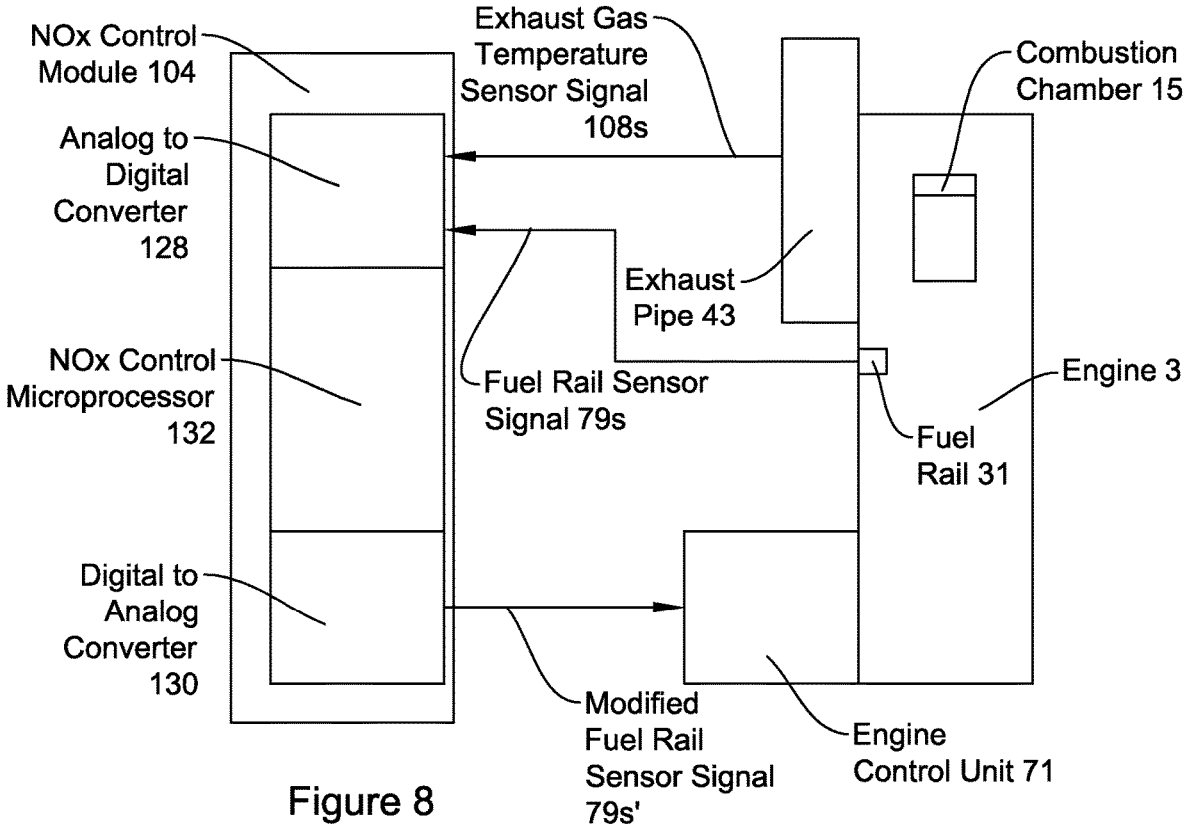

Before describing specific features of the CI engine system 100 shown in FIG. 4, brief descriptions are provided with reference to simplified control circuit FIGS. 7 to 10. These illustrate numerous ways that control circuit concepts are extendable to effect adjustment of dependent variables, such as the NOx emission level. With reference to FIG. 8, a voltage signal generated by a fuel rail pressure sensor is first routed through the NOx control module prior to input to the ECU. This voltage signal is modified based on an exhaust sensor output value prior to input to the OEM ECU. Exemplary sensors for this type of feedback control application may measure other dependent variables such as exhaust gas temperature or concentration of $O_2$, $NO_x$ or $SO_x$ in the engine exhaust. The sensor output may be routed through the control module and compared to a predetermined value to optimize or minimize the sensor value, e.g., to minimize a NOx emission level. Based on the difference between the received sensor voltage output and the predetermined value, an algorithm determines an adjustment to the voltage signal generated by the fuel rail pressure sensor. The adjustment modifies the rate of primary fuel delivery to reduce the difference between a sensor voltage output and a predetermined value. The control circuitry continues to modify the rate of primary fuel delivery until the difference between the predetermined value and the measured value of the dependent variable approaches zero.

Figure 9:
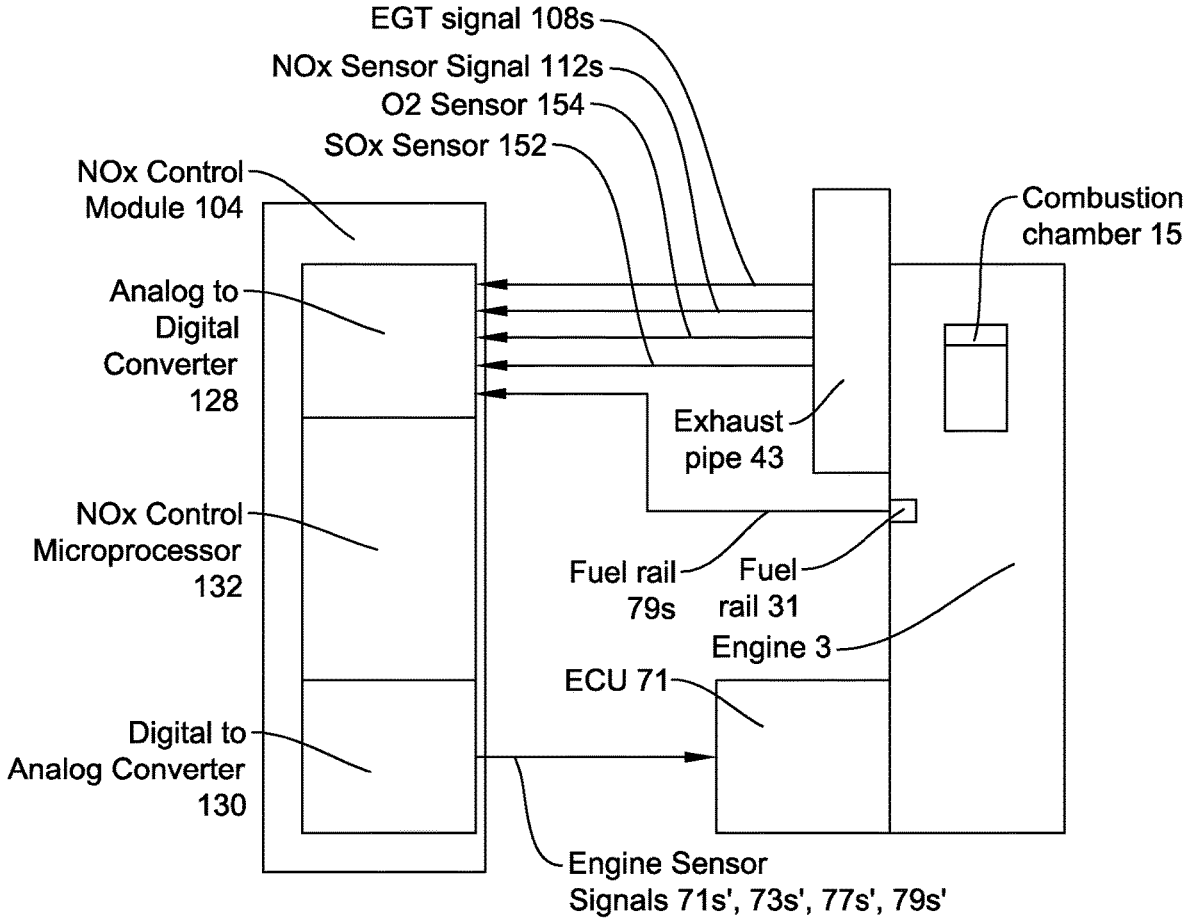

The control circuitry of FIG. 9 modifies the rate of delivery of secondary fuel to adjust one or more dependent variables. Exemplary inputs to the loop are analog signal received from any one or more of an exhaust gas temperature sensor, an oxygen sensor, a NOx sensor a SOx sensor. The sensor voltage output is routed through the control module 104, digitized and compared to a predetermined value. Based on the difference between the sensor voltage output and the predetermined value, an algorithm or a matrix of values is used to determine an adjustment to the rate of delivery of the secondary fuel. In another embodiment, when the secondary fuel source is generated at the engine, e.g., via an oxyhydrogen generator, the comparison between measured temperature and a reference temperature value can be used to determine whether to turn the secondary fuel delivery on or off or to vary the rate of oxyhydrogen production by altering the power or by powering down the generator.

Figure 10:
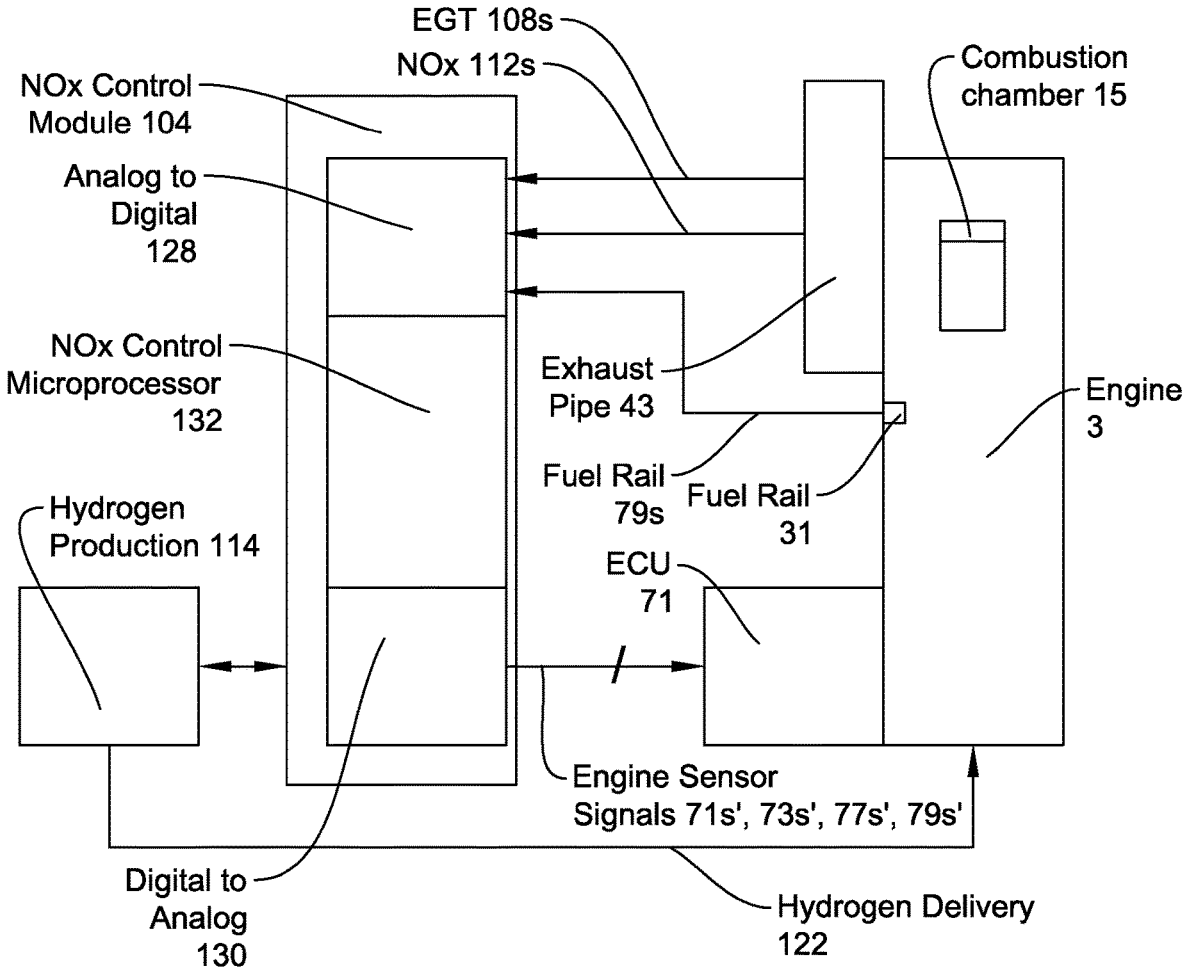

As illustrated in FIG. 10, a combination of afore described control circuits or loops may be formed in the system to operate sequentially or simultaneously to modify one or more engine parameters based on sensor data inputs to the control module 104. In this embodiment, both the volumetric flow of the primary fuel and the volumetric flow of the secondary fuel are adjusted, e.g., to adjust one or several variables. The input to each control circuit may be an analog signal received from a sensor. Each sensor voltage output is routed through the control module 104 where it is compared to a predetermined value. Based on the difference between each sensor voltage output and an associated predetermined value assigned for the sensor, an algorithm or a matrix of values is used to determine a command signal sent to control delivery of, for example, the secondary fuel or to adjust a voltage signal generated by a sensor, e.g., the fuel manifold pressure sensor or a NOx sensor. Each adjustment is made to a sensor voltage signal prior to input of the signal to the ECU 71. Signals received from each analog sensor are converted to digital signals, adjusted in magnitude based on a determination made by an algorithm and converted to an analog signal. Each adjustment modifies an engine control parameter, e.g., the rate of primary fuel delivery, and may reduce the difference between an output voltage from one of the sensors and and an associated predetermined value. The control loops may continually modify the rate of primary fuel delivery until the difference between the predetermined value and the value of the measured dependent variable approaches zero.

Referring again to FIG. 4, the NOx control module 104 contains a serial bus 124 through which data is transferred between thermocouple circuitry 126, analog-to-digital converter (ADC) circuitry 128, digital-to-analog circuitry 130, and processing circuitry which includes a microprocessor 132 and memory 134. The processing circuitry is also interfaced with one or more communications modules 138 which may include GSM or CDMA or WiFi capability or a GPS receiver. The module 104 receives: a temperature signal 57*s* on line 57*l* from the exhaust gas sensor 57 which is input to the thermocouple circuitry 126; and the following signals which are input to the analog-to-digital converter circuitry 128: an air pressure signal 75*s* from the intake manifold pressure sensor 75, an exhaust pressure signal 77*s* from the exhaust pressure sensor 77, a fuel rail pressure signal 79*s* on line 79*l*, from the sensor 79, and a barometric pressure signal 81*s* from the sensor 81 on line 81*l*.

Digitized sensor signals output from the thermocouple circuitry 126 and the analog-to-digital converter circuitry 128 are transmitted on the serial bus 124 to the microprocessor 132 which determines changes in HHO production levels (e.g., based on weighted sensor data). The microprocessor 132 also modifies the magnitudes of several sensor signals: the pressure signal 75*s* from the intake manifold pressure sensor 75, the pressure signal 77*s* from the exhaust pressure sensor 77, the fuel rail pressure signal 79*s* from the sensor 79, and the barometric pressure signal 81*s* from the sensor 81. The revised signal magnitudes are sent to the digital-to-analog circuitry 130 over the bus 124 and are then output to the ECU 71 to perform functions, including modification of the air-to-primary (diesel) fuel ratio and control of dependent variables such as NOx emissions.

In one embodiment the control of variables is had through the process of continually monitoring data acquired with sensors while adjusting independent variables. In one application the rate of primary fuel delivery, an independent variable, is adjusted while comparing values of a dependent variable to effectively modify the rate of primary fuel delivery until the difference between the predetermined value and the measured value of the dependent variable approaches zero or a minimum. Similarly, the rate of delivery of secondary fuel, also an independent variable, is adjusted while comparing values of a dependent variable (e.g., the level of NOx emissions) to effectively adjust the magnitude of the dependent variable. To this end, the sensor output may be routed through the control module 104, digitized and compared to a predetermined value. Based on the difference between the sensor voltage output and the predetermined value, an algorithm or a matrix of values is used to determine an adjustment to the independent variable. Thus under conditions where the engine power is increased increasing the flow rate of a primary fuel into the engine, control circuitry may adjust the rate of delivery of the secondary fuel as the rate of primary fuel delivery changes.

Figure 4A:
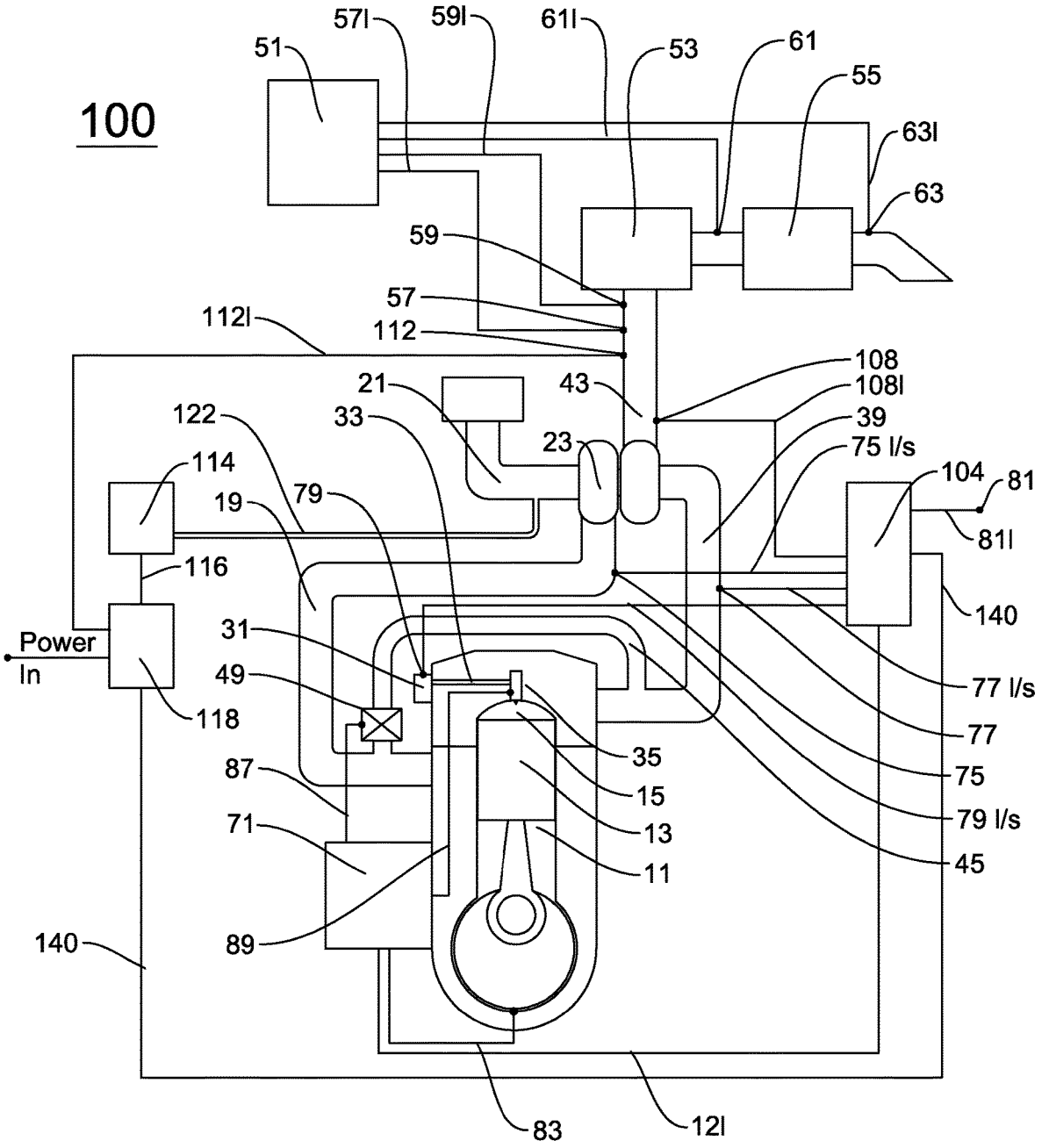
FIG. 4A is a schematic illustration of a CI engine system according to an embodiment of the invention which incorporates a NOx control system comprising a control module and a hydrogen generation system.
Figure 11:
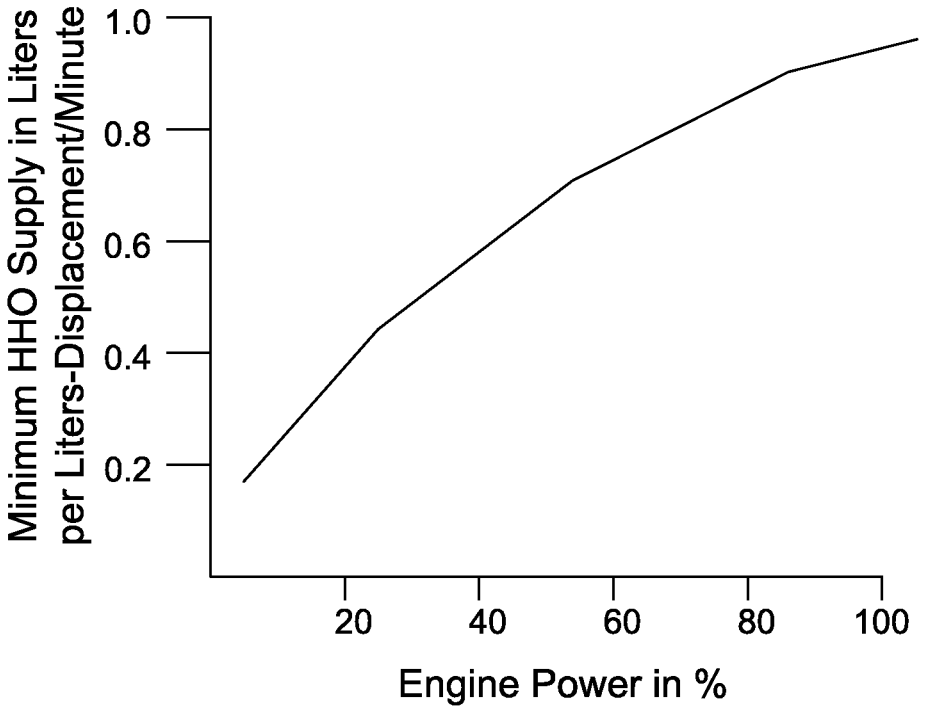
FIG. 11 illustrates a general relationship of a minimum HHO injection to achieve NOx reduction as a function of engine power.

The hydrogen generation system includes a hydrogen generator 114 and hydrogen control electronics 118 shown in FIG. 4A. The NOx control module 104 continually determines an optimal HHO production level to minimize the output of NOx. This level may be based on feedback control or based on a predetermined relationship developed through acquisition of characterization data. The hydrogen control electronics 118 receives a signal indicative of this level via an optically isolated RS232 serial link 140. See FIG. 4C. Generally the HHO production level increases as a function of engine output. It has been determined that to effect NOx reduction at high engine output levels the engine should receive a minimum of one liter of HHO per minute per liter of engine displacement. The general relationship is between minimum HHO injection and engine power is shown in FIG. 11.

The hydrogen control electronics 118 includes a CPU 142 which controls HHO production and safety control, and MOSFETs 144 that regulate the rate of hydrogen production, including regulation of electrolytic cells that produce the HHO, and regulation of the electrolyte pump, electrolyte heaters and cooling fans. The electronics monitors temperature to provide data for cooling and to assure safe limits of operation. The CPU also controls circuitry 148 which includes safety interlock switches and electrolyte level monitors. Signals 112*s* from the NOx sensor 112 are received via a CANBUS into the CPU 142 and transferred to the microprocessor 132 in the NOx control module 104 via the RS232 serial link 140. The microprocessor 132 monitors the NOx signal as part of the control function which minimizes emissions as a function of shifts in magnitudes of the independent variable signals to 75*s*', 77*s*', 79*s*' and 81*s*' which are sent to the ECU 71 in lieu of signals 75*s*, 77*s*, 79*s* and 81*s*.

Figure 4B:
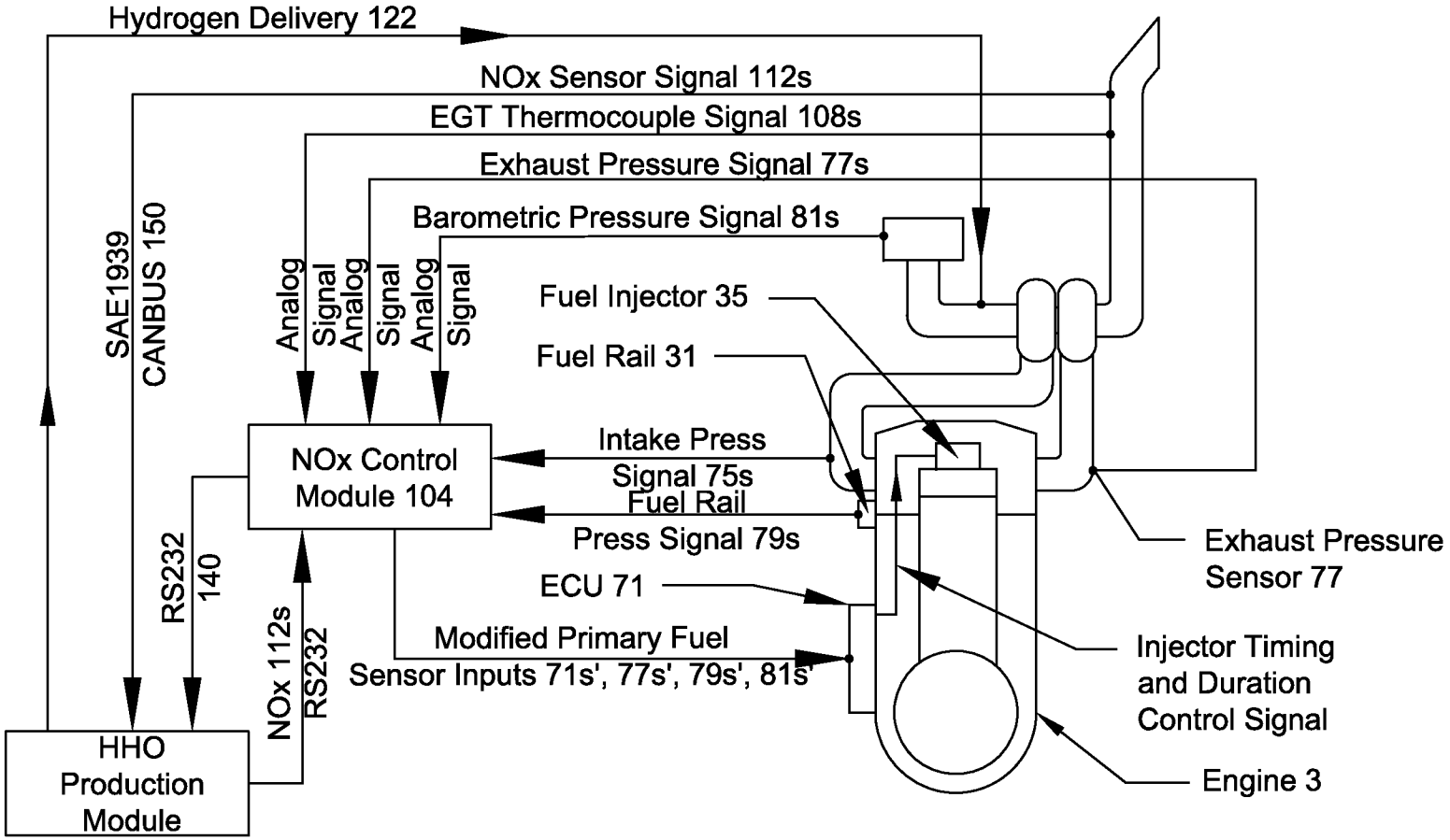
FIG. 4B illustrates control circuitry of the CI engine system of FIG. 4A.
Figure 4C:
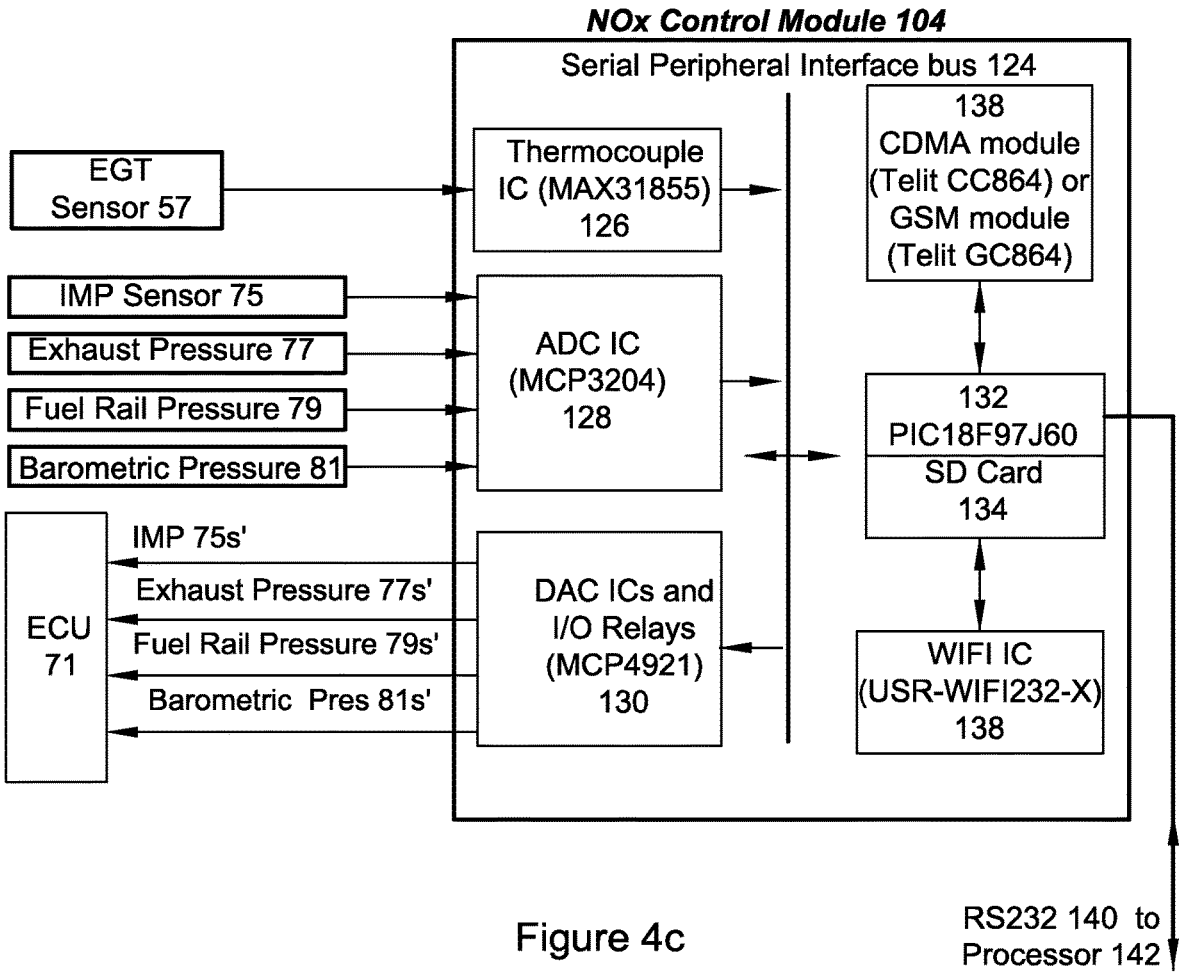
FIG. 4C illustrates the control module of FIG. 4A.
Figure 4D:
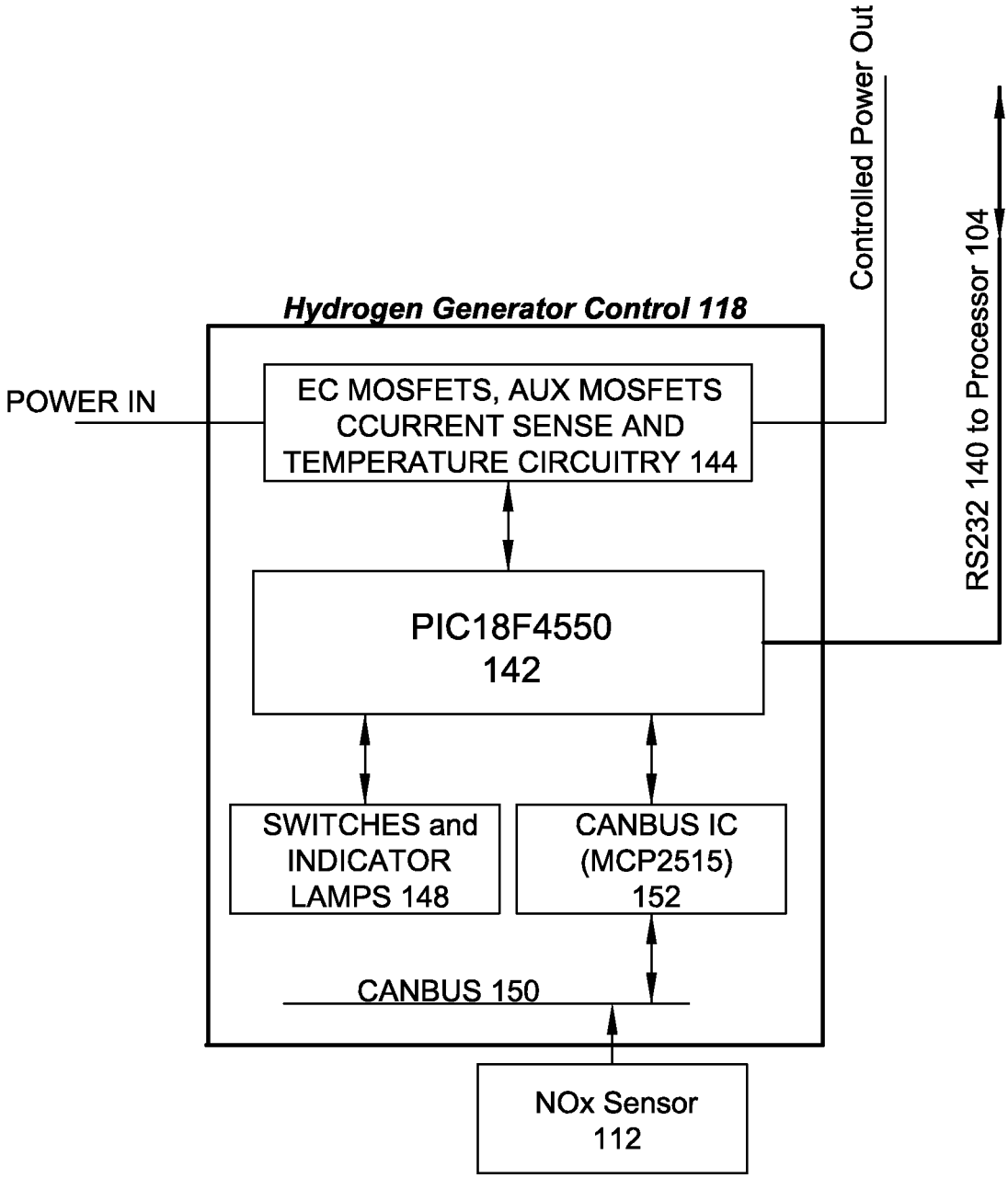
FIG. 4D illustrates hydrogen control electronics of the hydrogen generation system shown in FIG. 4A.

With further reference to FIG. 4B, operation of the NOx control system begins on engine start-up with the NOx control module 104 determining that the intake manifold pressure 71 is above ambient pressure. After thirty seconds the control module 104 sends a signal to the hydrogen generation control electronics 118 via the optically isolated RS232 line 140. In response to the signal the control electronics 118 sends a predetermined level of power to the hydrogen generator 114 to start production at minimum level. This initiates control loop activity with the NOx control module 104 receiving and processing values from the sensors, e.g., the OEM barometric pressure sensor 73, the intake manifold pressure sensor 75, the exhaust manifold pressure 77, the fuel rail pressure sensor 79 and the barometric pressure sensor 81. The NOx control module 104 shifts the magnitudes of the sensor signals 73*s*, 75*s*, 77*s*, 79*s*, 81*s* to adjusted magnitudes 73*s*', 75*s*', 77*s*', 79*s*', 81*s*' and passes those shifted values via the lines 73*l*, 75*l*, 77*l* 79*l* and 81*l* to the ECU 71 in lieu of the values 73*s*, 75*s*, 77*s*, 79*s*, 81*s* causing an adjustment in the air-to-fuel ratio. The NOx control module 104 also reads the values of the exhaust gas temperature signal 108*s* and the NOx sensor signal 112. The microprocessor 132 receives digital values of these sensor magnitudes and values and calculates a new value, based on the signal data received from the sensors 108 and 112, for an appropriate HHO production level to reduce the output of NOx. That updated level is sent to the hydrogen generation control electronics 118 via the RS232 line 40, causing a power change in operation of the hydrogen generator 114 to adjust the production of the HHO. The NOx control module 104 then cycles back to read sensor signals 73*s*, 75*s*, 77*s*, 79*s*, 81*s* and continues operation.

Figure 5:
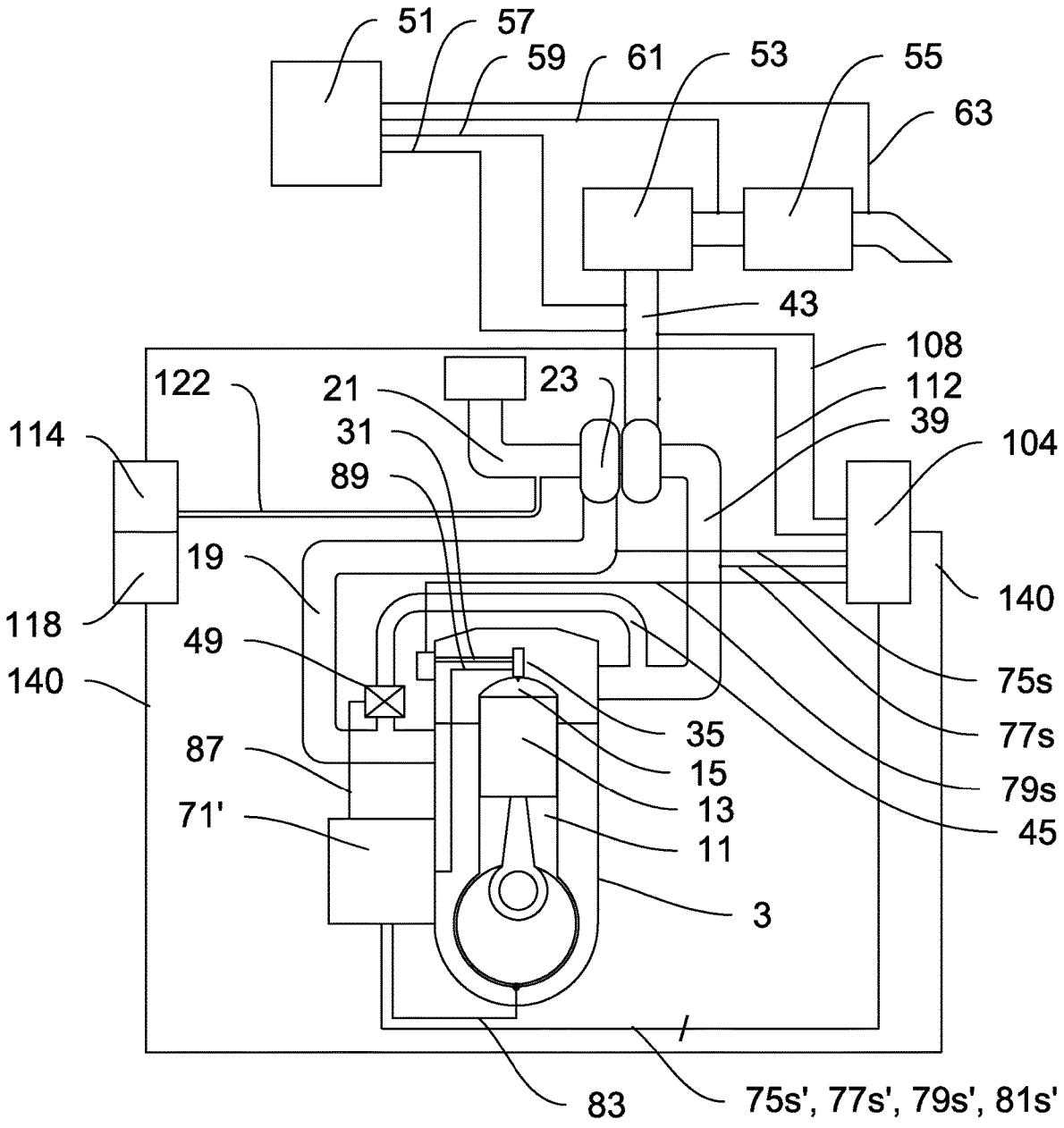
FIG. 5 illustrates another embodiment of the CI engine system according to the invention.

FIG. 5 illustrates the CI engine system 100 according to another embodiment of the invention. This embodiment of system 100 includes many of the features of the engine system 1 shown in FIG. 4 and like features are identified with like reference numbers. However, the embodiment of FIG. 4 integrates the functionality of the NOx control module 104 into the ECU, which is designated as ECU 71. Integration of this functionality provides multiple advantages. For example, less hardware is required to modify the pulse widths of the fuel injection signals. Further, the adjustments to the fuel system can be made directly to the injector circuitry, whereas in the embodiment of FIG. 4 the adjustments are made by changing an independent variable, i.e., to provide a pseudo value, which causes the ECU to change the timing or width of the pulses. It is also contemplated that, with integration of these functionalities, numerous modifications of the control circuitry may be had to effect a more efficient or responsive NOx control system.

Figure 6:
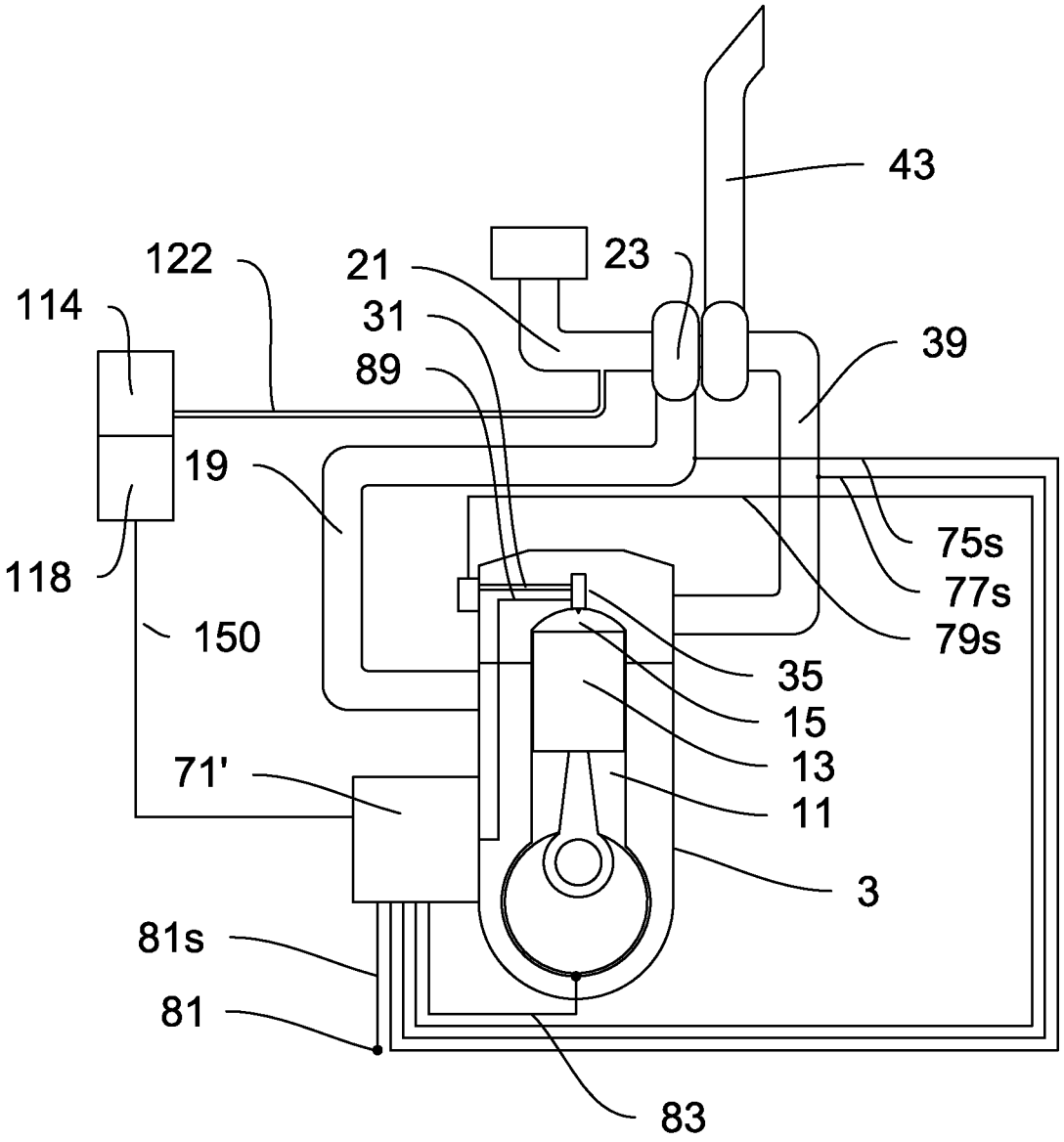
FIG. 6 illustrates still another embodiment of the CI engine system according to the invention.
Figure 7:
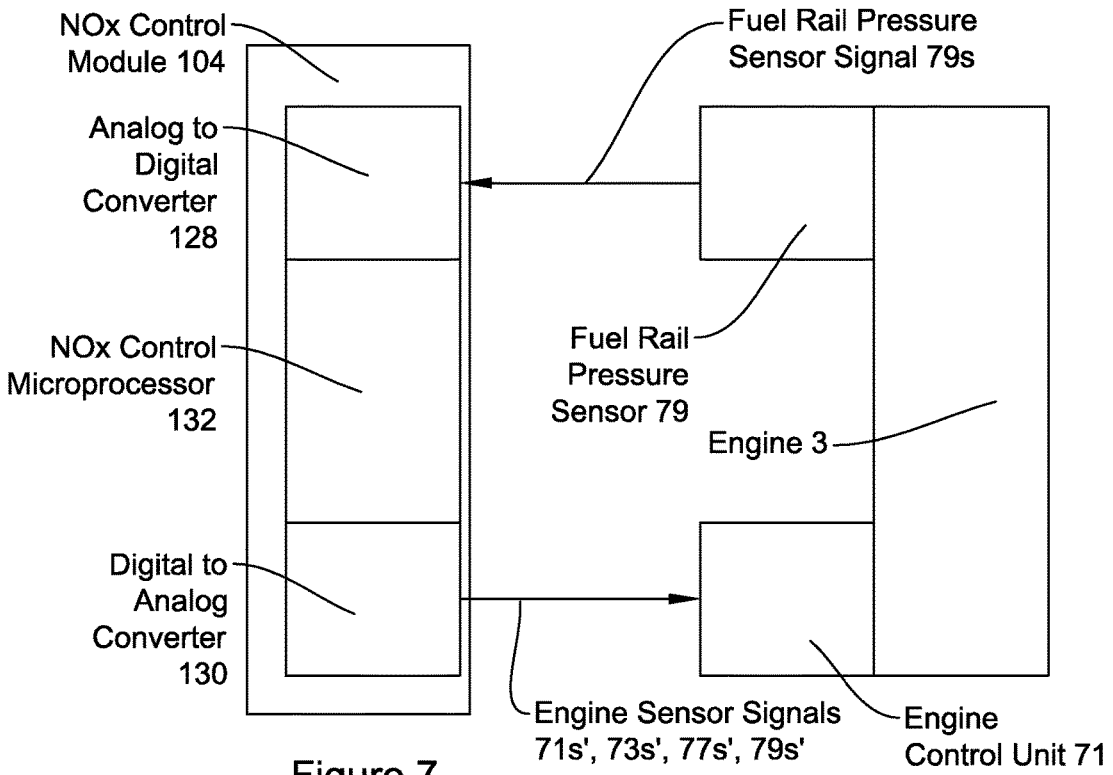
FIGS. 7-10 are schematic illustrations of CI engine systems according to embodiments of the invention to illustrate numerous ways that control circuit concepts are extendable to effect adjustment of dependent variables, including NOx emission levels.

FIG. 6 illustrates the CI engine system 100 according to still another embodiment of the invention which includes many of the features of the engine system 1 shown in FIGS. 4 and 5, with like features are identified with like reference numbers. Given a sufficient volume of reactive hydrogen production (e.g., greater than one liter of HHO per minute per liter of engine displacement) the mitigation of NOx emissions by the NOx control system can be so effective as to remove any need for both the EGR emissions control system and the secondary exhaust emissions control system. Advantageously, this eliminates high maintenance costs and wear on the engine 3.

While it has been a desire in the art to deploy systems which utilize secondary fuels, there has been no recognition that secondary fuels can be applied to CI and SI engines to reduce NOx emissions. The present invention provides system configurations incorporating secondary fuels and associated methods which can result in high fuel efficiency and NOx pollution reduction, each accompanied by high reliability under engine loading, whereas prior system designs which use secondary fuels for fuel efficiency have not shown consistent performance under the typical ranges of engine operating conditions. With the afore described methods, the benefits of premixing a gaseous second fuel source with air for injection into cylinders of an internal combustion engine can provide NOx reduction with the addition of control systems that are designed to continually monitor and adjust the engine parameters. A feature of illustrated embodiments is adjustment of parameters during or after changes in engine operating conditions. With respect to vehicles operating with a secondary fuel source, it is possible to both optimize fuel efficiency and reduce NOx emissions under both dynamic and steady state modes, e.g., for vehicle operation under acceleration or under constant speed conditions.

Field data can be used to identify key variables and develop input adjustment signals, e.g., based on measured concentration levels, to control NOx concentrations. The control may be effected with an algorithm that generates control signals used to modify engine parameters including parameters conventionally used to adjust engine performance or emission levels.

It is well known that engines operate at an air-to-fuel ratio that is typically lower than the ideal or stoichiometric ratio. A feature of the invention is adjustment of the air-to-fuel ratio for a primary fuel (e.g., gasoline or diesel fuel) in a dual fuel combustion process. The terms "dual fuel process" and "secondary fuel" as used herein refer to supplying an engine with a first, main fuel, e.g., a liquid fuel such as diesel fuel or gasoline, and a second fuel, typically in a lesser quantity, such as a gaseous mixture having a substantial content by volume of reactive hydrogen or another reactive species. With other relevant parameters remaining unchanged, a reduced fuel volume results in an increased air-to-fuel ratio. With a gaseous secondary fuel present in the cylinders adverse effects of reducing the fuel-to-air ratio are less severe than when running the engine without the secondary fuel. Consequently there is an expanded range of acceptable air-to-fuel ratio from which an optimum ratio can be selected to improve fuel economy and or lower NOx emissions. A feedback control loop may be provided to use a parameter in an algorithm which generates an adjustment value to mitigate NOx emissions. The control loop may also be used to adjust the measured parameter by modifying an input variable, e.g., the air-to-fuel ratio. Weighting functions may be assigned to determine relative influence of multiple control loops. The weighting functions may vary temporally or based on engine operating conditions, including ambient states.

During extensive over-the-road testing optimum points at which to shift the magnitudes of the sensor output signals were identified to take full advantage of the addition of the HHO over the full range of operating conditions. To that end the present invention applies a control that continuously reads multiple engine sensors (e.g., fuel manifold pressure, intake manifold pressure, exhaust manifold pressure, exhaust gas temperature, ambient barometric pressure, etc.) and dynamically adjusts those sensor readings to achieve optimum levels of emissions reduction and enhanced fuel economy. The modified levels may then be further adjusted in response to two additional sensors signal outputs: a NOx sensor and an Exhaust Gas Temperature sensor, before the sensor signals are passed on to the ECU. This results in the decreased output of NOx, HC and PE thus reducing the load on EGR systems and exhaust after-treatment systems.

Features of the invention have been illustrated for engines having OEM electronic control systems, but the disclosed concepts may be extended to engines not having such systems. In one series of embodiments, such engines may be equipped with custom versions of an electronic control module to provide one or more of the functionalities which have been disclosed. As another example, for an engine having a mechanical fuel injection system, an analog or digital control may be incorporated to adjust the amount of primary fuel delivered to the engine by electrically or mechanically adjusting the fuel manifold pressure. The pressure adjustment may be had by providing an adjustable relief valve or a selectable secondary relief valve with a lower set pressure than that of the primary relief valve.

While the invention has been described with reference to particular embodiments, it will be understood by those skilled in the art that various changes may be made and equivalents may be substituted for elements thereof without departing from the scope of the invention. Accordingly, the scope of the invention is only limited by the claims which follow.

The claimed invention is:

1. A method for operating an internal combustion engine under dynamically varying conditions, comprising:

injecting a liquid primary fuel into the engine;

monitoring a magnitude of an engine characteristic with a sensor positioned to measure magnitudes of a first dependent variable associated with combustion of the primary fuel in the presence of a secondary fuel, the dependent variable taken from the group consisting of exhaust gas temperature, NOx content and SOx content;

injecting into the engine a combustible, gaseous product comprising reactive hydrogen as the secondary fuel while injecting the primary fuel into the engine; and while the primary fuel is being delivered into the engine, continually adjusting a rate of delivery of the reactive hydrogen into the engine as operation of the engine is changed under the dynamically varying conditions, said adjusting including, over a range of sixty percent to one hundred percent of engine power, continually increasing the rate of delivery of the reactive hydrogen into the engine while continually increasing a rate at which the primary fuel is delivered into the engine to change the magnitude of the engine characteristic.

2. The method of claim 1 wherein the step of adjusting the rate of delivery of the reactive hydrogen includes generating a control signal which varies as a function of the monitored magnitude of the engine characteristic or is based on a predetermined functional relationship; and the control signal is applied to reduce NOx emissions based in part on the monitored magnitude of the engine characteristic or the predetermined functional relationship.

3. The method of claim 1 wherein the primary fuel is a diesel fuel and adjusting the rate of delivery of the reactive hydrogen into the engine limits NOx emissions levels from the engine.

4. The method of claim 1 wherein, as the engine power is increased, an increase in flow rate of the gaseous product injected into the engine limits an NOx emissions level.

5. The method of claim 1 including applying a control signal to adjust an engine setting to reduce $NO_X$ emissions based in part on the measured magnitudes of the first dependent variable and wherein the engine setting is the ratio of air flow to primary fuel flow, ratio of air flow to secondary fuel flow, or the ratio of secondary fuel flow to primary fuel flow.

6. The method of claim 1 wherein the reactive hydrogen is oxyhydrogen.

7. The method of claim 1 wherein the reactive hydrogen is generated by electrolysis.

8. The method of claim 1 wherein the reactive hydrogen is a species taken from the set consisting of atomic hydrogen, molecular hydrogen and $H^+$.

9. The method of claim 1 wherein the reactive hydrogen is provided in the form of $H_2O_2$.

10. The method of claim 1 wherein the reactive hydrogen is generated from a hydrocarbon compound in the presence of heat and a catalytic material, or by generation of a plasma or by thermal cracking or a UV photoelectric process.

11. The method of claim 1 wherein, during the step of continually increasing the rate of delivery of the reactive hydrogen into the engine while continually increasing the rate at which the primary fuel is delivered into the engine, the rate of delivery of the reactive hydrogen into the engine is increased as a function of engine power when engine power is increased by increasing the flow rate of primary fuel.

12. The method of claim 11 wherein the increase in the rate of delivery of the reactive hydrogen when increasing the rate at which the primary fuel is delivered into the engine reduces NOx content of exhaust gas produced by the engine.

13. An engine system comprising:

an internal combustion engine configured to receive both a primary fuel and a secondary fuel comprising reactive hydrogen into one or more chambers in which a combustion process occurs, including a fuel injection system, an air intake manifold and a fuel manifold;

electronic control circuitry configured to control timing and metering of the primary fuel and the secondary fuel in the combustion process so that, while the primary fuel is being delivered into the engine, a rate of delivery of the reactive hydrogen into the engine is continually adjusted as operation of the engine is changed, said adjusting including, over a range of sixty percent to one hundred percent of engine power, continually increasing the rate of delivery of the reactive hydrogen into the engine while continually increasing a rate at which the primary fuel is delivered into the engine to change a magnitude of an engine characteristic; and a sensor positioned to measure magnitudes of a dependent variable associated with combustion of the primary fuel in the presence of the secondary fuel, the dependent variable taken from the group consisting of exhaust gas temperature, NOx content and SOx content.

14. The system of claim 13 wherein the electronic control circuitry is configured to apply a control signal to adjust an engine setting to improve engine fuel economy.

15. The system of claim 13 wherein the dependent variable is a NOx exhaust emissions level and the internal combustion engine is configured to receive the primary fuel as a liquid fuel and the secondary fuel as a gaseous fuel, and the electronic control circuitry is configured to apply a control signal to adjust the flow rate of the secondary fuel to reduce the $NO_X$ emissions based in part on the magnitude of the dependent variable.

16. The system of claim 13 wherein, during the step of continually increasing the rate of delivery of the reactive hydrogen into the engine while continually increasing the rate at which the primary fuel is delivered into the engine, the rate of delivery of the reactive hydrogen into the engine is increased as a function of engine power when engine power is increased.

17. The system of claim 16 wherein the engine power is increased by increasing the flow rate of primary fuel.

18. The system of claim 13, wherein the electronic control circuitry is configured to apply a control signal, based on the measured magnitude of the dependent variable to adjust an engine setting to reduce $NO_X$ emissions.

19. The system of claim 18 wherein the system provides a gaseous secondary fuel comprising the reactive hydrogen and the control signal adjusts the engine setting based on changes in engine operation under dynamically varying conditions while the secondary fuel is being delivered into the engine.

20. In an electronic system which controls timing and metering of a primary fuel delivered for combustion in an internal combustion engine, the system including one or more sensors for measuring engine operating parameters, and a processor unit configured to provide outputs based on sensor measurements to control settings for engine operation, an electronic subsystem for connection between a sensor and the processor unit, comprising:

first circuitry configured to receive from a sensor a first signal having a first magnitude and generate a second signal having a second magnitude different from the first signal magnitude, the second signal provided for input to the processor unit, the difference between the first magnitude and the second magnitude configured to provide an adjustment to an output from the processor unit to improve engine fuel efficiency and reduce NOx emissions while a gaseous product comprising reactive hydrogen is input to a combustion chamber of the engine wherein:

when the second signal is provided to the processor the primary fuel flow rate is adjusted, and the first circuitry is configured to provide a third signal for control of the flow rate of the gaseous product comprising reactive hydrogen into the engine.

* * * * *